US007809554B2

(12) United States Patent
Oh

(10) Patent No.: US 7,809,554 B2
(45) Date of Patent: Oct. 5, 2010

(54) APPARATUS, METHOD AND MEDIUM FOR DETECTING VOICED SOUND AND UNVOICED SOUND

(75) Inventor: Kwangcheol Oh, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1562 days.

(21) Appl. No.: 11/050,666

(22) Filed: Feb. 7, 2005

(65) Prior Publication Data

US 2005/0177363 A1 Aug. 11, 2005

(30) Foreign Application Priority Data

Feb. 10, 2004 (KR) ..... 10-2004-0008740

(51) Int. Cl.
*G10L 11/06* (2006.01)

(52) U.S. Cl. ..... 704/208; 704/E11.003; 704/E11.004; 704/E11.007; 704/233

(58) Field of Classification Search ..... 704/208, 704/214, E11.003, E11.004, E11.007, 233
See application file for complete search history.

(56) References Cited

U.S. PATENT DOCUMENTS

| | | | | |
|---|---|---|---|---|
| 4,074,069 | A * | 2/1978 | Tokura et al. | 704/208 |
| 4,589,131 | A * | 5/1986 | Horvath et al. | 704/214 |
| 4,820,059 | A * | 4/1989 | Miller et al. | 704/254 |
| 5,341,456 | A | 8/1994 | Dejaco | |
| 5,664,052 | A * | 9/1997 | Nishiguchi et al. | 704/214 |
| 5,732,389 | A * | 3/1998 | Kroon et al. | 704/223 |
| 5,809,453 | A * | 9/1998 | Hunt | 704/214 |
| 5,809,455 | A * | 9/1998 | Nishiguchi et al. | 704/214 |
| 5,960,388 | A * | 9/1999 | Nishiguchi et al. | 704/208 |
| 6,230,122 | B1 * | 5/2001 | Wu et al. | 704/226 |
| 6,385,573 | B1 * | 5/2002 | Gao et al. | 704/220 |
| 6,510,407 | B1 * | 1/2003 | Wang | 704/207 |
| 6,823,303 | B1 * | 11/2004 | Su et al. | 704/220 |
| 6,850,884 | B2 * | 2/2005 | Gao et al. | 704/224 |
| 6,983,242 | B1 * | 1/2006 | Thyssen | 704/208 |
| 7,065,485 | B1 * | 6/2006 | Chong-White et al. | 704/208 |
| 7,081,581 | B2 * | 7/2006 | Allamanche et al. | 84/616 |
| 7,318,030 | B2 * | 1/2008 | Guduru | 704/243 |

(Continued)

FOREIGN PATENT DOCUMENTS

| | | |
|---|---|---|
| WO | WO 01/29825 | 4/2001 |

OTHER PUBLICATIONS

J. H. L. Hansen, "Speech enhancement employing adaptive boundary detection and morphological based spectral constraints," Proc. IEEE ICASSP, pp. 901-904, 1991.*

(Continued)

*Primary Examiner*—Talivaldis Ivars Smits
*Assistant Examiner*—Greg A Borsetti
(74) *Attorney, Agent, or Firm*—Staas & Halsey LLP

(57) ABSTRACT

An apparatus, method, and medium for detecting a voiced sound and an unvoiced sound. The apparatus includes a blocking unit for dividing an input signal into block units; a parameter calculator for calculating a first parameter to determine the voiced sound and a second parameter to determine the unvoiced sound by using a slope and spectral flatness measure (SFM) of a mel-scaled filter bank spectrum of an input signal existing in a block; and a determiner for determining a voiced sound zone and an unvoiced sound zone in the block by comparing the first and second parameters to predetermined threshold values.

22 Claims, 12 Drawing Sheets

U.S. PATENT DOCUMENTS

2005/0114128 A1* 5/2005 Hetherington et al. ..... 704/233
2006/0089836 A1* 4/2006 Boillot et al. ..... 704/500

OTHER PUBLICATIONS

J. D. Markel and A. H. Gray "A spectral-flatness measure for studying the autocorrelation method of linear prediction speech analysis," IEEE Trans. Acoust., Speech, Signal Processing, vol. ASSP-22, pp. 207, Jun. 1974.*

K. El-Maleh and P. Kabal, "Comparison of voice activity detection algorithms for wireless personal communications systems," in Proc. CCECE'97 Can. Conf. Electrical Computer Engineering, vol. 2, 1997, pp. 470-473.*

K. Srinivasan and A. Gersho, "Voice activity detection for cellular networks," in Proc. IEEE Speech Coding Workshop, 1993, pp. 85-86.*

J. Picone, "Signal Modeling Techniques in Speech Recognition," Proc. of the ICASSP, vol. 81, No. 9, 1993, pp. 1215-1247.*

J. Faneuff and D.R. Brown III, Noise reduction and increased VAD accuracy using spectral subtraction, Proceedings of the International Signal Processing Conference (2003), p. 213.*

Rodet et al. "Speech Analysis and Synthesis Methods based on Spectral Envelopes and Voiced/Unvoiced Functions", 1987.*

Robert E. Yantorno, et al., "The Spectral Autocorrelation Peak Valley Ratio (SAPVR)—A Usable Speech Measure Employed as a Co-channel Detection System", Proceedings of IEEE International Workshop on Intelligent Signal Processing, May 24, 2001, Retrieved from the Internet: www.temple.edu/speech_lab/IEEE_WISP_2001_V5.PDF.

George Tzanetakis, et al., "Multifeature Audio Segmentation for Browsing and Annotation", Applications of Signal Processing to Audio and Acoustics, 1999 IEEE Workshop on New Paltz, NY, USA. Oct. 17-20, 1999, pp. 103-106.

Jürgen Herre, et al., "Robust Matching of Audio Signals Using Spectral Flatness Features", IEEE Workshop on the Applications of Signal Processing to Audio and Acoustics 2001, Oct. 21-24, 2001, pp. 127-130.

European Search Report, mailed Dec. 28, 2006, and issued in corresponding European Patent Application No. 05250613.6-1224 in the English Language.

Korean Office Action dated Jul. 7, 2010, issued in corresponding Korean Application No. 10-2004-0008740.

* cited by examiner

APPARATUS, METHOD AND MEDIUM FOR DETECTING VOICED SOUND AND UNVOICED SOUND

CROSS-REFERENCE TO RELATED APPLICATIONS

This application claims the benefit of Korean Patent Application No. 10-2004-0008740, filed on Feb. 10, 2004, in the Korean Intellectual Property Office, the disclosure of which is incorporated herein in its entirety by reference.

BACKGROUND OF THE INVENTION

1. Field of the Invention

The present invention relates to an apparatus, method, and medium for detecting a voiced sound and an unvoiced sound, and more particularly, to an apparatus, method, and medium for detecting a voiced sound zone and an unvoiced sound zone using a spectral flatness measure (SFM) and a slope of a mel-scaled filter bank spectrum obtained from a voice signal in a predetermined zone.

2. Description of the Related Art

Various encoding methods that perform signal compression using statistical attributes and human auditory characteristics of a voice signal in a time domain or frequency domain have been suggested. To encode a voice signal, information determining whether the input voice signal is a voiced sound or an unvoiced sound is typically used. A method of detecting a voiced sound and an unvoiced sound from an input voice signal can be divided into a method performed in the time domain and a method performed in the frequency domain. The method performed in the time domain complexly uses at least one of a frame average energy of a voice signal and a zero-cross rate, and the method performed in the frequency domain uses information on low frequency and high frequency components of the voice signal or pitch harmonic information. If the conventional methods described above are used in a clean environment, satisfactory detection performance can be guaranteed. However, if the conventional methods described above are used in a white noise environment, the detection performance is considerably deteriorated.

SUMMARY OF THE INVENTION

Embodiments of the present invention provide an apparatus, method, and medium for detecting a voiced sound zone and an unvoiced sound zone from a voice signal in a block preferably by dividing the voice signal into units of predetermined size of blocks and using a spectral flatness measure (SFM) and a slope of a mel-scaled filter bank spectrum obtained from the voice signal existing in the block.

To achieve the above and/or other aspects and advantages, embodiments of the present invention include a method of detecting a voiced sound and an unvoiced sound, the method including dividing an input signal into block units, calculating a slope and a spectral flatness measure (SFM) of a mel-scaled filter bank spectrum, calculating a first parameter to determine the voiced sound and a second parameter to determine the unvoiced sound by using the slope and the spectral flatness measure (SFM) of the mel-scaled filter bank spectrum of the input signal existing in a block, and determining a voiced sound zone and an unvoiced sound zone in the block by comparing the first and the second parameters to predetermined threshold values.

The calculating of the slope and SFM may include calculating the slope by modeling the mel-scaled filter bank spectrum as a first order function, and calculating the SFM using a geometric average and an arithmetic average of a spectrum obtained by removing the slope from the mel-scaled filter bank spectrum.

The determining of the voiced sound zone and the unvoiced sound zone may include comparing a first signal waveform obtained by applying the first parameter obtained from the slope to the input signal of the block and a first threshold value, comparing a second signal waveform obtained by applying the second parameter obtained from the slope and SFM to the input signal of the block and a second threshold value, determining a zone, which has a value larger than the first threshold value in the first signal waveform as a result of the comparing of the first signal waveform and the first threshold value, as a voiced sound zone, and determining a zone, which has a value larger than the second threshold value in the second signal waveform as a result of the comparing of the second signal waveform and the second threshold value, as an unvoiced sound zone.

The first parameter may be obtained using a first slope calculated at an entire frequency area of the mel-scaled filter bank spectrum.

The first parameter may be obtained using a first slope calculated at an entire frequency area of the mel-scaled filter bank spectrum and a second slope calculated at a predetermined low frequency area of the entire frequency area.

The first parameter may be obtained using a first slope calculated at an entire frequency area of the mel-scaled filter bank spectrum, a second slope calculated at a predetermined low frequency area of the entire frequency area, and a third slope calculated at a predetermined high frequency area of the entire frequency area.

The second parameter may be obtained by a difference between the SFM and the slope calculated at the entire frequency area of the mel-scaled filter bank spectrum.

To achieve the above and/or other aspects and advantages, embodiments of the present invention include an apparatus for detecting a voiced sound and an unvoiced sound, the apparatus including a blocking unit for dividing an input signal into block units, a parameter calculator for calculating a first parameter to determine the voiced sound and a second parameter to determine the unvoiced sound by using a slope and spectral flatness measure (SFM) of a mel-scaled filter bank spectrum of the input signal existing in a block, and a determiner for determining a voiced sound zone and an unvoiced sound zone in the block by comparing the first and second parameters to predetermined threshold values.

The parameter calculator may include a first spectrum acquisitor obtaining a mel-scaled filter bank spectrum from an input signal existing in a block provided from the blocking unit, a first parameter calculator calculating a slope of the mel-scaled filter bank spectrum provided from the first spectrum acquisitor and a first parameter to determine the voiced sound using the slope, a second spectrum acquisitor obtaining a second spectrum in which the slope at an entire frequency area is removed from the mel-scaled filter bank spectrum, and a second parameter calculator calculating a spectral flatness measure (SFM) of the second spectrum provided from the second spectrum acquisitor and a second parameter to determine the unvoiced sound using the slope and SFM.

The first parameter calculator may set a first slope calculated at an entire frequency area of the mel-scaled filter bank spectrum as the first parameter.

The first parameter calculator may add a first slope calculated at an entire frequency area of the mel-scaled filter bank spectrum to a second slope calculated at a predetermined low frequency area of the entire frequency area, and then set the added result as the first parameter.

The first parameter calculator may adds a first slope calculated at an entire frequency area of the mel-scaled filter bank spectrum, a second slope calculated at a predetermined low frequency area of the entire frequency area, and a third slope calculated at a predetermined high frequency area of the entire frequency area and sets the added result as the first parameter.

The second parameter calculator may set a difference between the SFM and the slope calculated at the entire frequency area of the mel-scaled filter bank spectrum as the second parameter.

The determiner may compare a first signal waveform obtained by applying the first parameter obtained from the slope to the input signal of the block and a first threshold value and determines a zone, which has a value larger than the first threshold value in the first signal waveform as a result of the comparing of the first signal waveform and the first threshold value, as a voiced sound zone.

The determiner may compare a second signal waveform obtained by applying the second parameter obtained from the slope and SFM to the input signal of the block and a second threshold value and determines a zone, which has a value larger than the second threshold value in the second signal waveform as a result of the comparing of the second signal waveform and the second threshold value, as an unvoiced sound zone.

To achieve the above and/or other aspects and advantages, embodiments of the present invention include a medium which includes computer-readable instructions, for detecting a voiced sound and an unvoiced sound, the medium including dividing an input signal into block units, calculating a slope and a spectral flatness measure (SFM) of a mel-scaled filter bank spectrum, calculating a first parameter to determine the voiced sound and a second parameter to determine the unvoiced sound by using the slope and the spectral flatness measure (SFM) of a mel-scaled filter bank spectrum of the input signal existing in a block, and determining a voiced sound zone and an unvoiced sound zone in the block by comparing the first and the second parameters to predetermined threshold values.

Calculating the slope and SFM may include calculating the slope by modeling the mel-scaled filter bank spectrum as a first order function, and calculating the SFM using a geometric average and an arithmetic average of a spectrum obtained by removing the slope from the mel-scaled filter bank spectrum.

Determining the voiced sound zone and the unvoiced sound zone may include comparing a first signal waveform obtained by applying the first parameter obtained from the slope to the input signal of the block and a first threshold value, comparing a second signal waveform obtained by applying the second parameter obtained from the slope and SFM to the input signal of the block and a second threshold value, determining a zone, which has a value larger than the first threshold value in the first signal waveform as a result of the comparing of the first signal waveform and the first threshold value, as a voiced sound zone, and determining a zone, which has a value larger than the second threshold value in the second signal waveform as a result of the comparing of the second signal waveform and the second threshold value, as an unvoiced sound zone.

The first parameter may be obtained using a first slope calculated at an entire frequency area of the mel-scaled filter bank spectrum.

The first parameter may be obtained using a first slope calculated at an entire frequency area of the mel-scaled filter bank spectrum and a second slope calculated at a predetermined low frequency area of the entire frequency area.

The first parameter may be obtained using a first slope calculated at an entire frequency area of the mel-scaled filter bank spectrum, a second slope calculated at a predetermined low frequency area of the entire frequency area, and a third slope calculated at a predetermined high frequency area of the entire frequency area.

The second parameter may be obtained by a difference between the SFM and the slope calculated at the entire frequency area of the mel-scaled filter bank spectrum.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
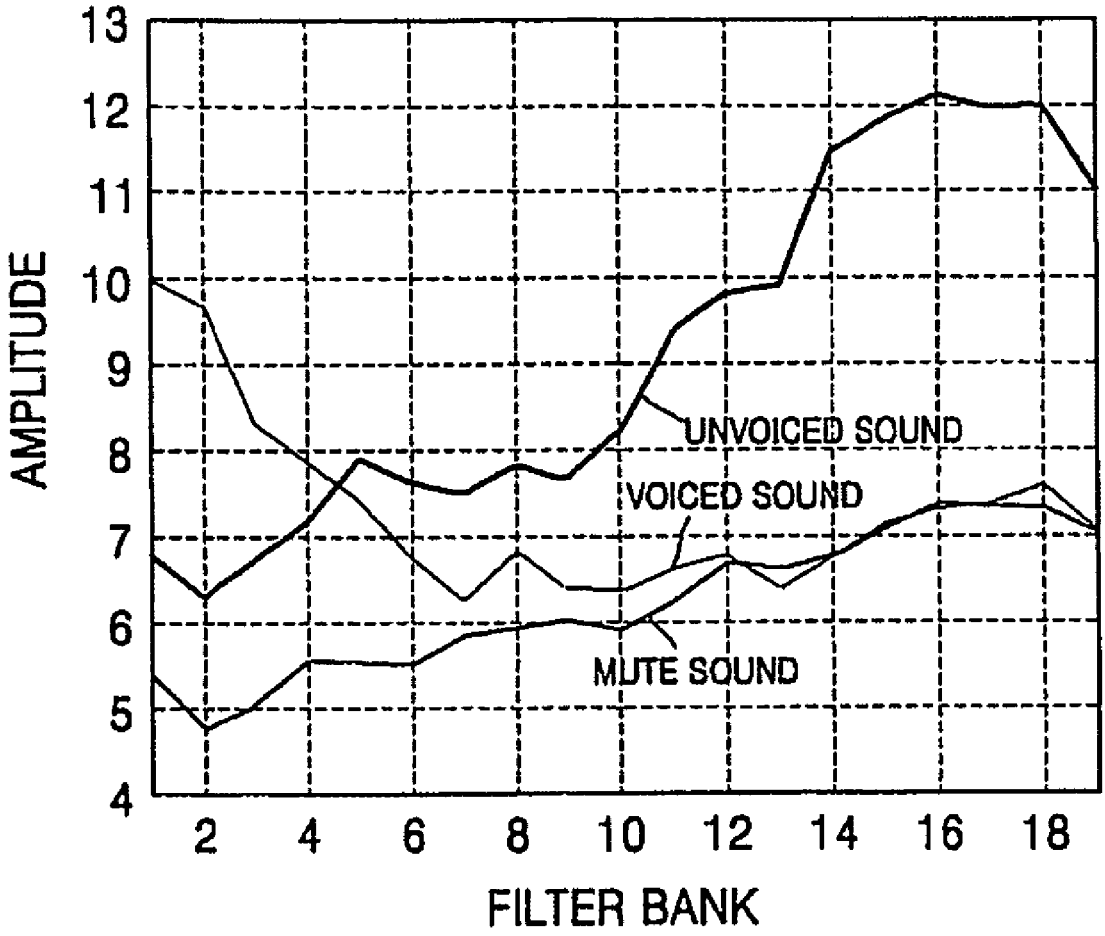
FIG. 1 is a graph showing characteristics of mel-scaled filter bank spectra of silence, a voiced sound, and an unvoiced sound.

Reference will now be made in detail to exemplary embodiments of the present invention, examples of which are illustrated in the accompanying drawings, wherein like reference numerals refer to the like elements throughout. The embodiments are described below to explain the present invention by referring to the figures.

FIG. 1 is a graph showing characteristics of mel-scaled filter bank spectra of a silence, a voiced sound, and an unvoiced sound. In an exemplary embodiment of the present invention, a mel-scaled filter bank spectrum may be obtained from received voice data, and a voiced sound zone and unvoiced sound zone may be detected using at least one of a spectral flatness measure (SFM) and slope of the mel-scaled filter bank spectrum.

Figure 2:
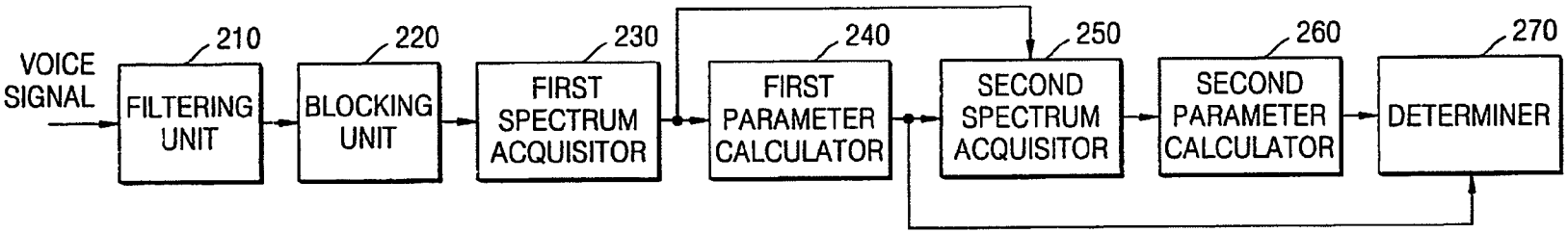
FIG. 2 is a block diagram of an apparatus for detecting a voiced sound and an unvoiced sound according to an exemplary embodiment of the present invention.

FIG. 2 is a block diagram of an apparatus for detecting a voiced sound and an unvoiced sound according to an exemplary embodiment of the present invention. The apparatus may include a filtering unit 210, a blocking unit 220, a first spectrum acquisitor 230, a first parameter calculator 240, a second spectrum acquisitor 250, a second parameter calculator 260, and a determiner 270. In this exemplary embodiment, a first spectrum acquisitor 230, a first parameter calculator 240, and a second spectrum acquisitor 250 serves as a parameter calculator.

Referring to FIG. 2, the filtering unit 210 may be implemented by an infinite impulse response (IIR) or finite impulse response (FIR) digital filter and serves as a low pass filter having a predetermined frequency characteristic, a cut-off frequency of which is, for example, 230 Hz. The filtering unit 210 removes undesirable high frequency components of analog-to-digital converted voice data by performing low pass filtering on the voice data and outputs the result to the blocking unit 220.

The blocking unit 220 reconfigures the voice data output from the filtering unit 210 in frame units by dividing the voice data into a constant time interval, each frame having a predetermined number of samples, and configures blocks, each block including a frame and a predetermined number of samples from the frame, for example, a 15 msec extended period. For example, if the size of a frame is 10 msec, the size of a block is 25 msec.

Figure 3A:
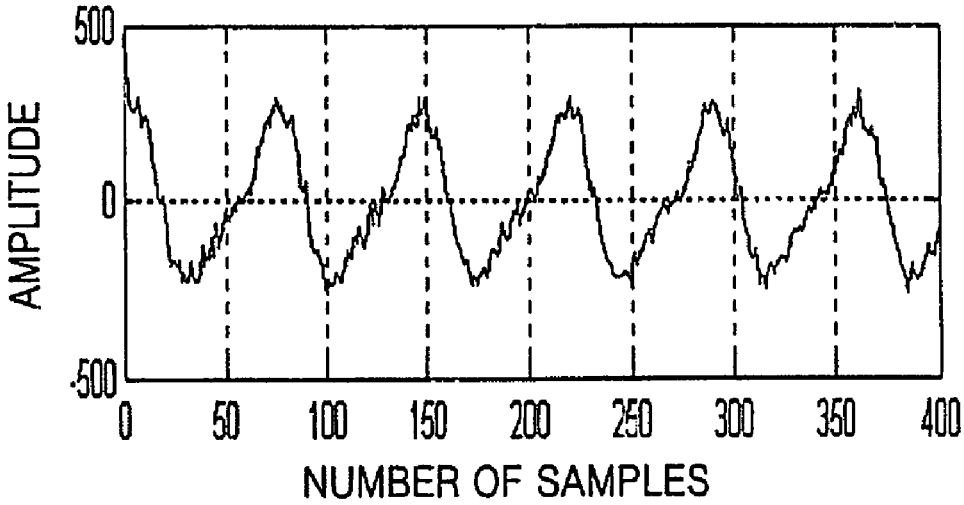
FIGS. 3A through 3D are graphs showing waveforms for illustrating an operation of a first spectrum acquisitor shown in the exemplary embodiment of FIG. 2.
Figure 3B:
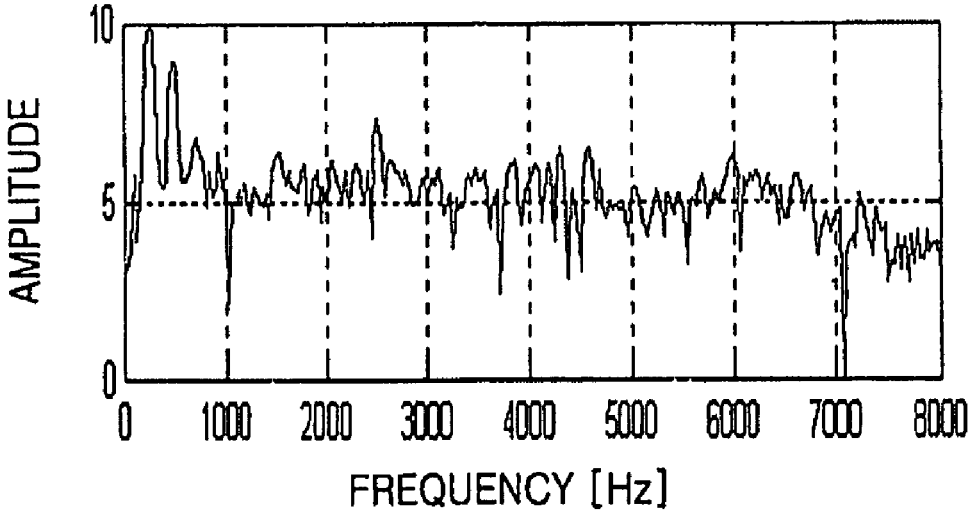
Figure 3C:
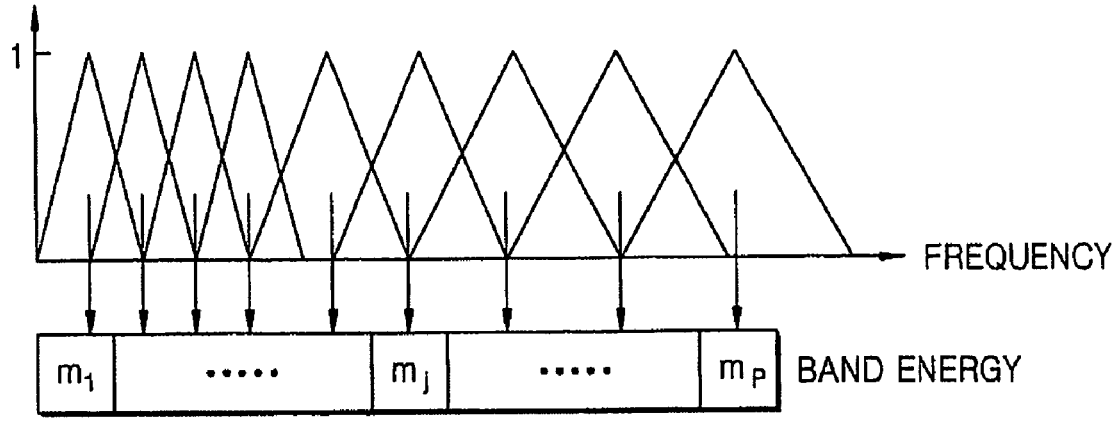
Figure 3D:
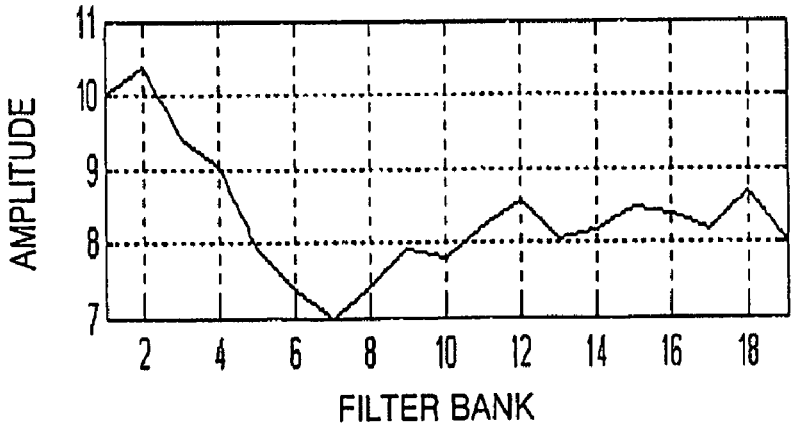

The first spectrum acquisitor 230 receives the voice data in units of blocks configured by the blocking unit 220 and obtains a mel-scaled filter bank spectrum of the voice data. This will be described in detail with reference to FIGS. 3A through 3D. A linear spectrum shown in FIG. 3B is obtained by performing a fast Fourier transform (FFT) on voice data of an n-th block shown in FIG. 3A, which is provided from the blocking unit 220. A mel-scaled filter bank spectrum shown in FIG. 3D, i.e., a first spectrum X(k), is obtained by applying P (here, P=19) mel-scaled filter banks shown in FIG. 3C to the linear spectrum shown in FIG. 3B.

Figure 4:
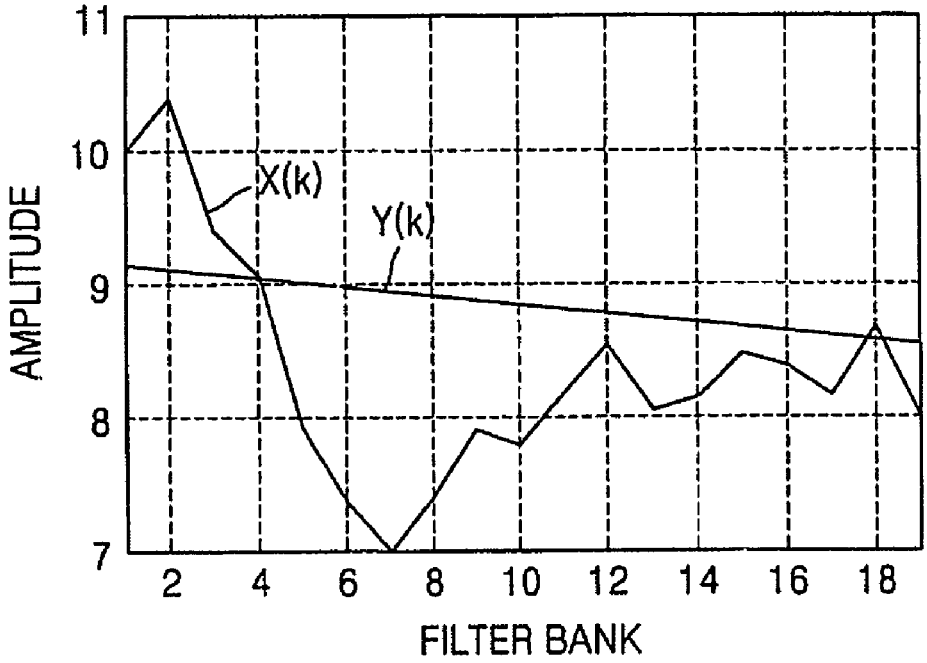
FIG. 4 is a graph showing a waveform for illustrating an operation of a first parameter calculator shown in the exemplary embodiment of FIG. 2.

The first parameter calculator 240 calculates a slope of the first spectrum X(k) output from the first spectrum acquisitor 230. This will be described in detail with reference to FIG. 4. First, a first order function Y(k) of the first spectrum X(k) is defined as shown in Equation 1.

$$Y(k)=aX(k)+b \qquad \text{Equation 1}$$

Slope a and constant b are obtained by using line fitting of the first order function. Technology related to the line fitting is described in "Numerical Recipes in FORTRAN 77, William H. Press, Brian P. Flannery, Saul A. Teukolsky, William T. Vetterling, Feb. 1993," but a detailed description is omitted.

Since the obtained slope commonly has a negative value for a voiced sound, the obtained slope is adjusted to have a positive value by multiplying the obtained slope by −1, and the adjusted slope is set as a first parameter p1 for voiced sound discrimination.

As an embodiment for setting the first parameter p1, a first slope obtained at an entire filter bank zone can be used. As another embodiment for setting the first parameter p1, besides the first slope, second and third slopes obtained by dividing the entire filter bank zone into a low frequency band area and a high frequency band area and performing the line fitting on each area can be used. This will be described later with reference to FIGS. 7 through 9.

Figure 5:
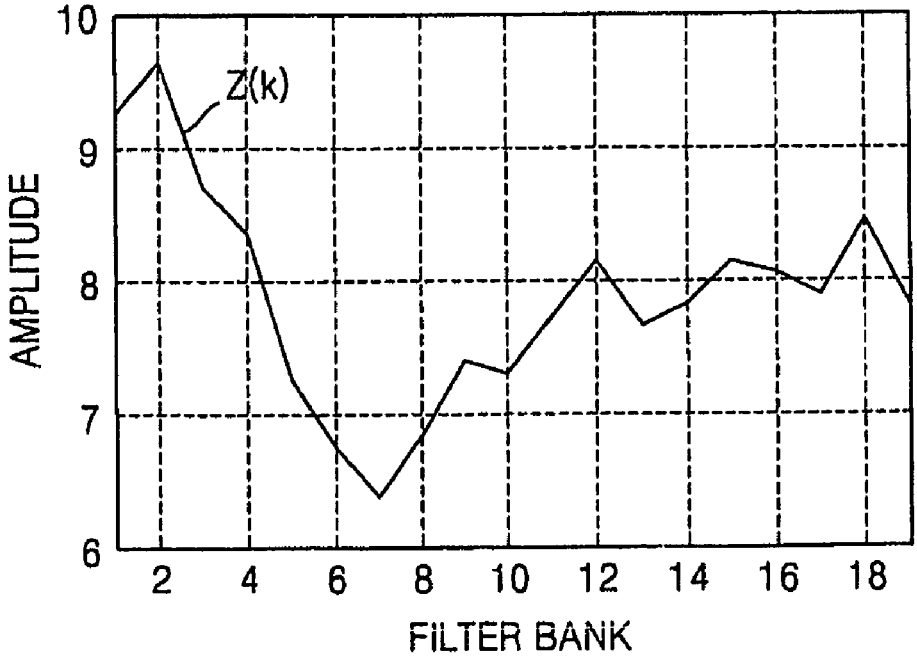
FIG. 5 is a graph showing a waveform for illustrating an operation of a second spectrum acquisitor shown in the exemplary embodiment of FIG. 2.

The second spectrum acquisitor 250 obtains a second spectrum Z(k) shown in FIG. 5 by removing the slope from the first spectrum X(k) output from the first spectrum acquisitor 230. Here, the second spectrum Z(k) can be represented as shown in Equation 2.

$$\begin{aligned} Z(k) &= X(k) - Y(k) + X_m(k) \\ &= X(k) - aX(k) - b + X_m(K) \end{aligned} \qquad \text{Equation 2}$$

In this equation, $X_m(k)$ indicates an average of the first spectrum X(k).

The second parameter calculator 260 calculates a spectral flatness measure (SFM) of the second spectrum output from the second spectrum acquisitor 250. The SFM can be defined as shown in Equation 3.

$$SFM = \frac{GM}{AM} \qquad \text{Equation 3}$$

In this equation, GM indicates a geometric mean of the second spectrum Z(k), and AM indicates an arithmetic mean of the second spectrum Z(k), and they can be defined as shown in Equation 4.

$$GM = \left[\prod_{k=0}^{P-1} Z(k)\right]^{1/P} \qquad \text{Equation 4}$$

$$AM = \frac{1}{P}\sum_{k=0}^{P-1} Z(k)$$

In this equation, P indicates the number of used filter banks.

A second parameter p2 for unvoiced sound discrimination is calculated using the calculated SFM and slope as shown in Equation 5.

$$p2=\text{SFM}-\lambda a \qquad \text{Equation 5}$$

In this equation, λ is a constant number indicating what percentage of the slope is reflected. A value of λ is approximately equal to 1. In the present exemplary embodiment, λ may preferably be equal to 0.75.

The determiner 270 respectively compares the first parameter p1 for voiced sound discrimination obtained by the first parameter calculator 240 to a first threshold value $\theta_1$ and the second parameter p2 for unvoiced sound discrimination obtained by the second parameter calculator 260 to a second threshold value $\theta_2$. The determiner 270 determines whether a voice signal of a relevant block indicates a voiced sound zone or an unvoiced sound zone according to the comparison result. The first threshold value $\theta_1$ and second threshold value $\theta_2$ are experimentally or empirically obtained in advance in the silent zone. A zone in which the first parameter p1 is larger than the first threshold value $\theta_1$ is determined as the voiced sound zone, and a zone in which the first parameter p1 is smaller than the first threshold value $\theta_1$ is determined as the unvoiced sound or the silent zone. That is, in the voiced sound zone, the slope a has a negative value, and in the unvoiced sound or the silent zone, the slope a has a positive value or a value near to 0. On the other hand, a zone in which the second parameter p2 is larger than the second threshold value $\theta_2$ is determined as the unvoiced sound zone, and a zone in which the second parameter p2 is smaller than the second threshold value $\theta_2$ is determined as the voiced sound or the silent zone. That is, in the voiced sound zone, the SFM is small and the slope a has a negative value, and in the unvoiced sound zone, the SFM and slope a are large, and in the silent zone, the SFM is small and the slope a is near to 0.

Figure 6:
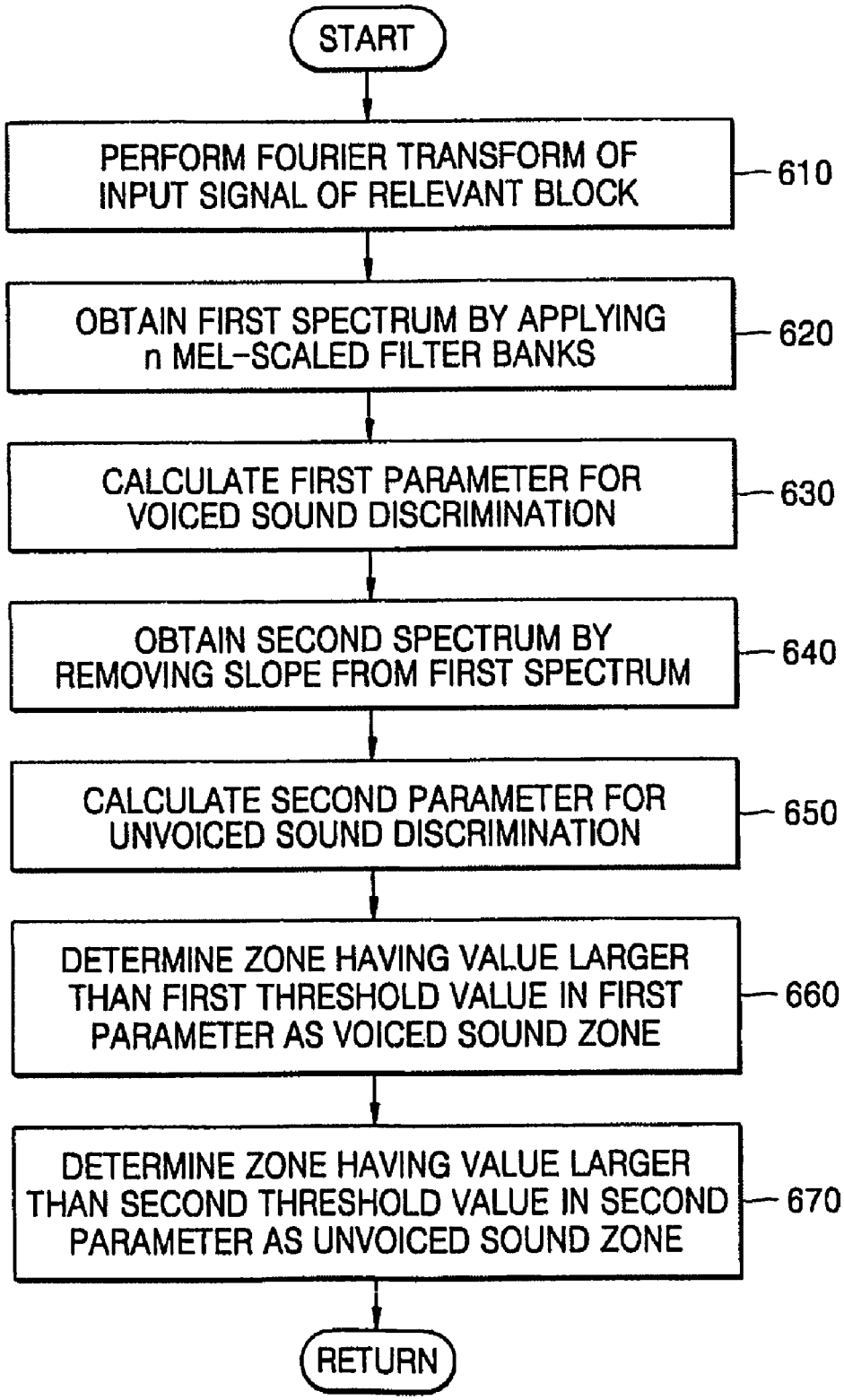
FIG. 6 is a flowchart of a method of detecting a voiced sound and an unvoiced sound according to an exemplary embodiment of the present invention.

FIG. 6 is a flowchart of a method of detecting a voiced sound and an unvoiced sound according to an embodiment of the present invention.

Referring to FIG. 6, in operation 610, an input signal of a block output from the blocking unit 220 is Fourier transformed and converted into a signal of a frequency domain. In operation 620, a first spectrum X(k) is obtained by applying P mel-scaled filter banks to the input signal of the block converted in operation 610.

In operation 630, the first spectrum X(k) is modeled as a first order function by applying line fitting, and a slope of the first order function is calculated as a first parameter p1 for voiced sound discrimination. In operation 640, a second spectrum Z(k) is obtained by removing the slope from the first spectrum X(k) obtained in operation 620.

In operation 650, an SFM is obtained from a geometric average and an arithmetic average of the second spectrum Z(k) obtained in operation 640, and a second parameter p2 for unvoiced sound discrimination is calculated from the slope of the first spectrum X(k) and the SFM of the second spectrum Z(k).

In operation 660, a zone having a value larger than a first threshold value in a waveform obtained by applying the first parameter p1 to the input signal of the block is determined as a voiced sound zone. In operation 670, a zone having a value larger than a second threshold value in a waveform obtained by applying the second parameter p2 to the input signal of the block is determined as an unvoiced sound zone.

Figure 7:
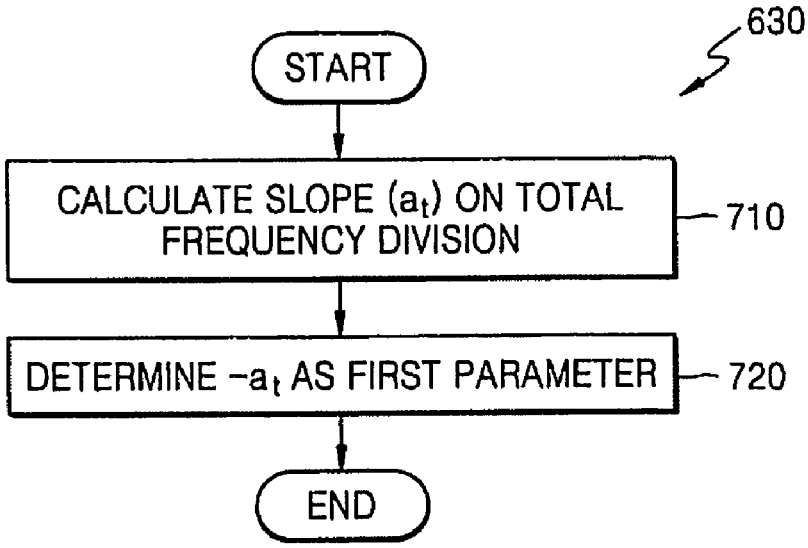
FIG. 7 is a flowchart of a first exemplary embodiment of operation 630 shown in FIG. 6.

FIG. 7 is a flowchart of a first exemplary embodiment of operation 630 shown in FIG. 6. Referring to FIG. 7, in operation 710, a first slope $a_t$ of an entire frequency area of the first spectrum X(k) obtained in operation 620 is calculated. In operation 720, a first parameter p1 is set by multiplying the first slope $a_t$ obtained in operation 710 by −1.

Figure 8:
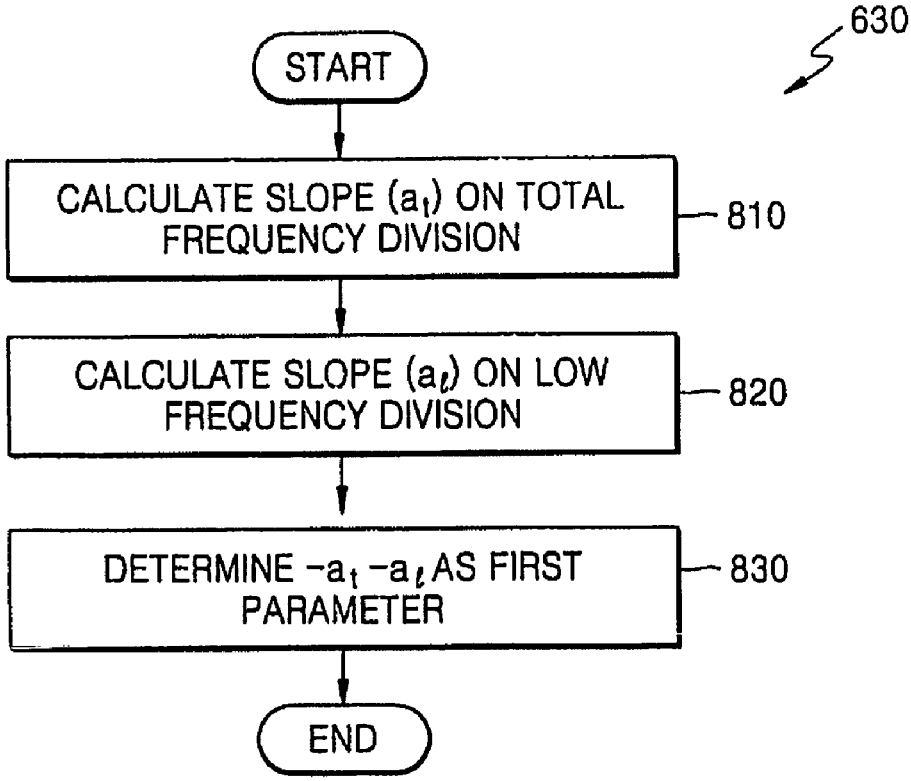
FIG. 8 is a flowchart of a second exemplary embodiment of operation 630 shown in FIG. 6.

FIG. 8 is a flowchart of a second exemplary embodiment of operation 630 shown in FIG. 6. Referring to FIG. 8, in operation 810, a first slope $a_t$ of an entire frequency area of the first spectrum X(k) obtained in operation 620 is calculated. In operation 820, the entire frequency area of the first spectrum X(k) is divided into two areas, that is, for example, a high frequency area and a low frequency area on the basis of a mel-frequency of a tenth filter bank of 19 filter banks, and a second slope $a_l$ of the low frequency area is calculated. In operation 830, a first parameter p1 is set by adding the first slope $a_t$ to the second slope $a_t$ and multiplying the added result by −1.

Figure 9:
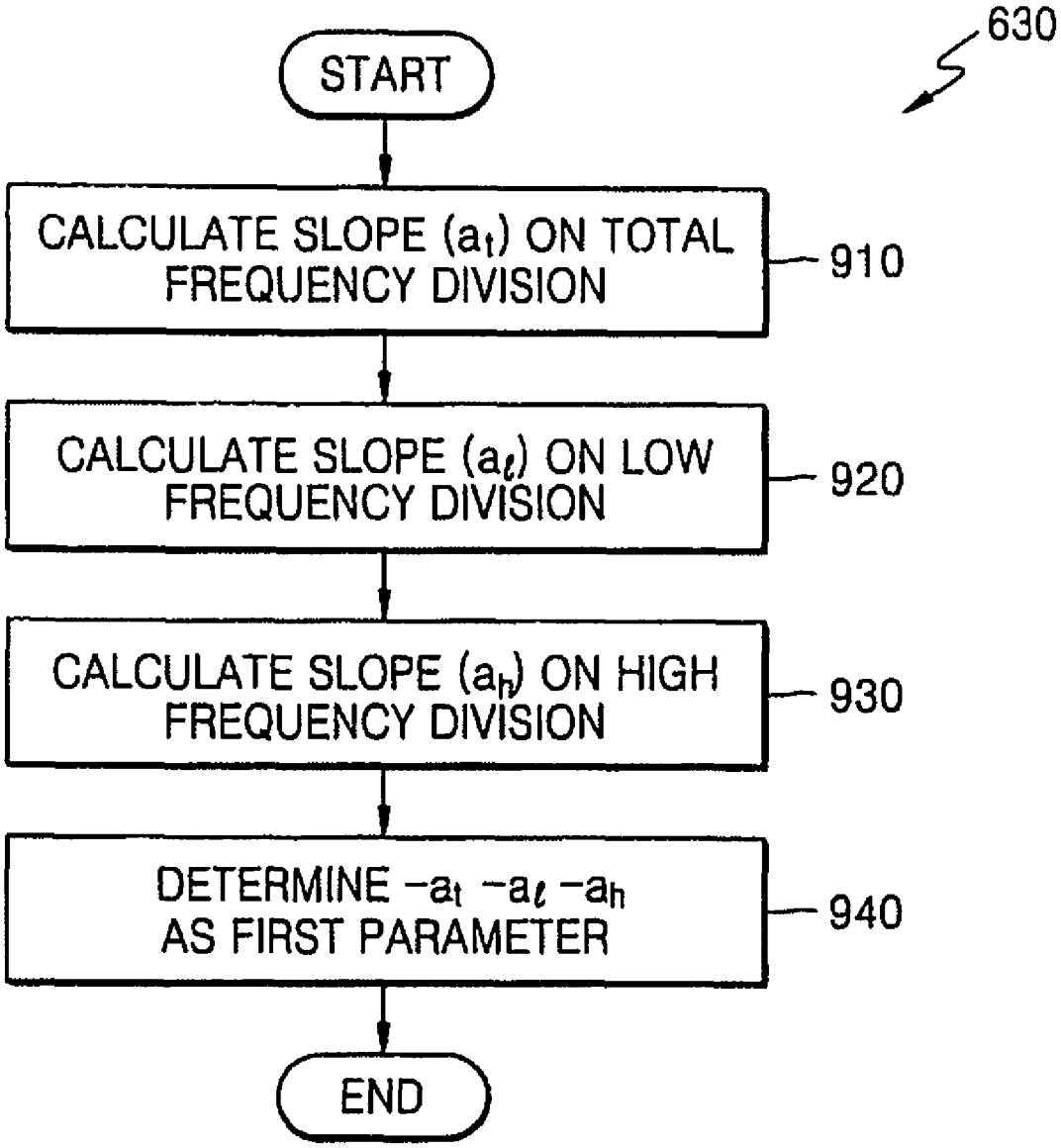
FIG. 9 is a flowchart of a third exemplary embodiment of operation 630 shown in FIG. 6.

FIG. 9 is a flowchart of a further exemplary embodiment of operation 630 shown in FIG. 6. Referring to FIG. 9, in operation 910, a first slope $a_t$ of an entire frequency area of the first spectrum X(k) obtained in operation 620 is calculated. In operation 920, the entire frequency area of the first spectrum X(k) is divided into two areas, that is, for example, a high frequency area and a low frequency area on the basis of a mel-frequency of a tenth filter bank of 19 filter banks, and a second slope $a_l$ of the low frequency area is calculated. In operation 930, a third slope $a_h$ of the high frequency area is calculated. In operation 940, a first parameter p1 is set by adding the first slope $a_t$, the second slope $a_l$, and the third slope $a_h$ and multiplying the added result by −1.

Figure 10:
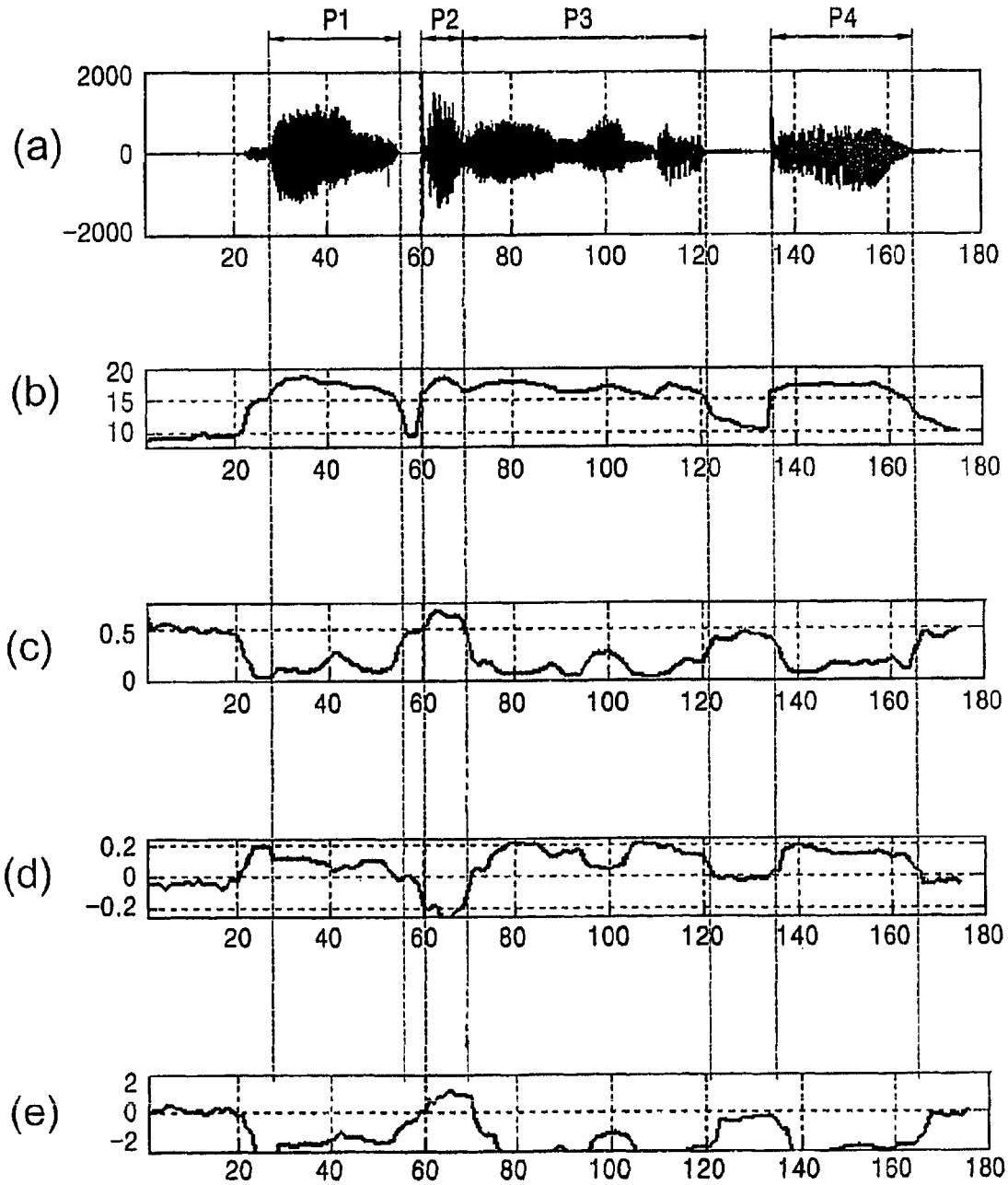
FIG. 10 shows graphs for comparing an exemplary method of detecting a voiced sound and unvoiced sound according to an exemplary embodiment of the present invention to that of a conventional method, with respect to a predetermined zone of an original signal.

FIG. 10 shows graphs for comparing a method of detecting a voiced sound and an unvoiced sound according to the present invention to that according to a conventional technology, with respect to a predetermined zone of an original signal. Graphs (b) and (c) are waveforms obtained by applying a frame average energy and a zero-cross rate to an original signal shown in a graph (a), respectively, and graphs (d) and (e) are waveforms obtained by applying a first parameter p1 and second parameter p2 according to the present invention to an original signal shown in the graph (a), respectively. Referring to FIG. 10, an unvoiced zone P2 and voiced zones P1, P3, and P4 existing in the graph (a) is classified more clearly in the graphs (d) and (e).

Figure 11:
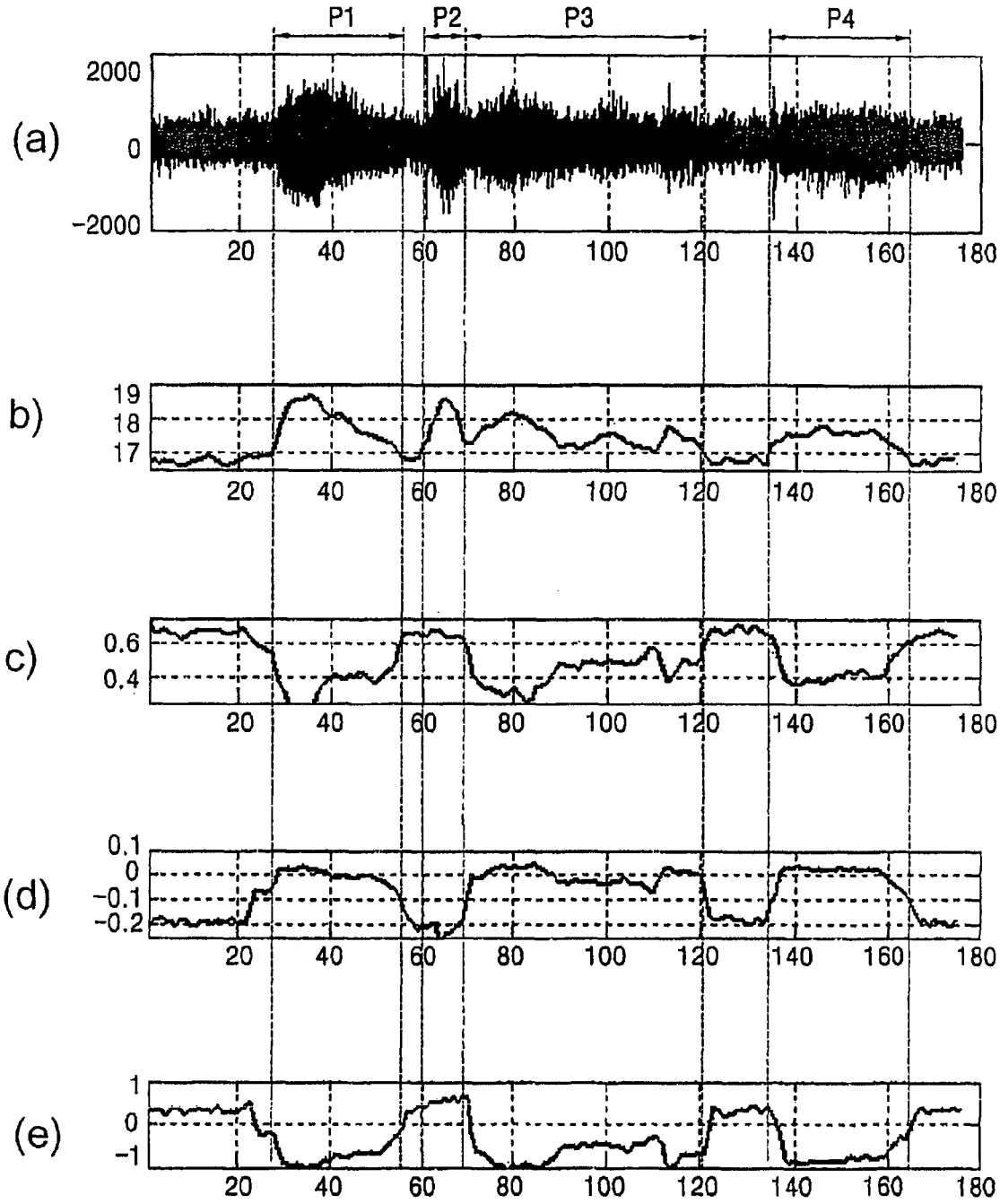
FIG. 11 shows graphs for comparing a method of detecting a voiced sound and unvoiced sound according to exemplary embodiments of the present invention to that of a conventional method, with respect to a predetermined zone of a signal including twenty (20) dB white noise.
Figure 12:
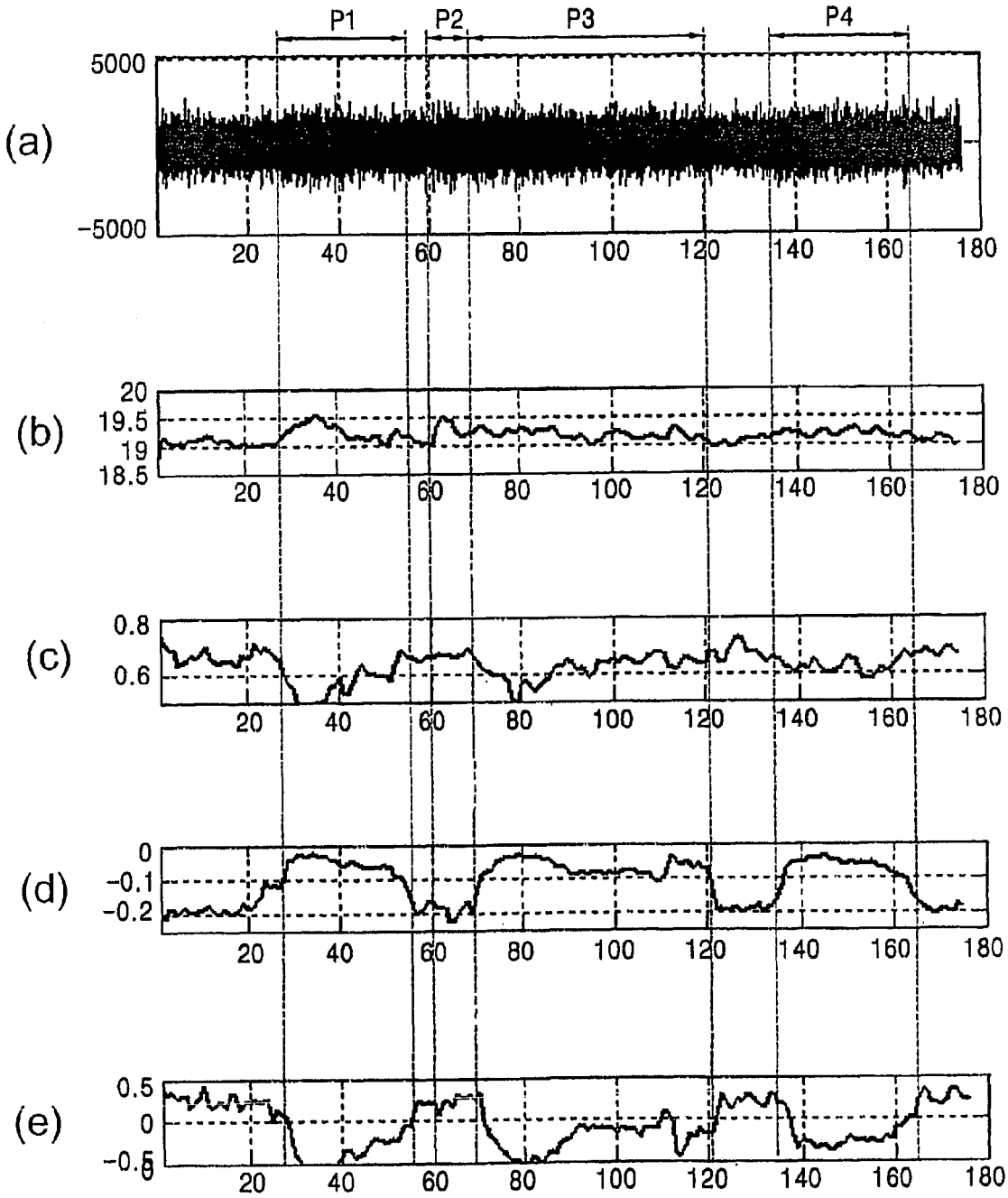
FIG. 12 shows graphs for comparing a method of detecting a voiced sound and unvoiced sound according to exemplary embodiments of the present invention to that of a conventional method, with respect to a predetermined zone of a signal including ten (10) dB white noise.
Figure 13:
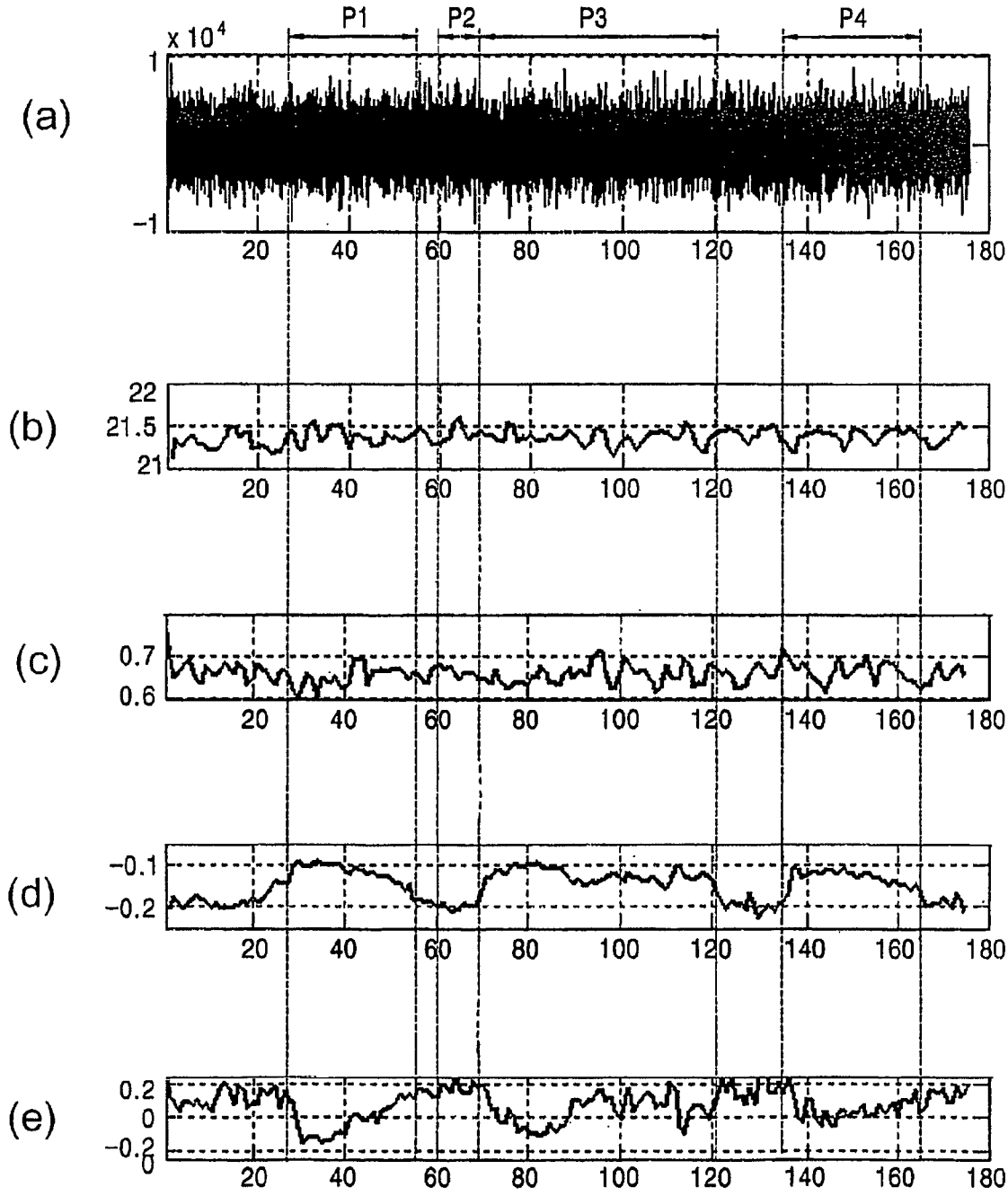
FIG. 13 shows graphs for comparing a method of detecting a voiced sound and unvoiced sound according to exemplary embodiments of the present invention to that of a conventional method, with respect to a predetermined zone of a signal including zero (0) dB white noise.

FIG. 11 shows graphs for comparing a method of detecting a voiced sound and an unvoiced sound according to an exemplary embodiment of the present invention to that of a conventional method, with respect to a predetermined zone of a signal including 20 dB white noise. FIG. 12 shows graphs for comparing a method of detecting a voiced sound and an unvoiced sound according to an exemplary embodiment of the present invention to that of a conventional method, with respect to a predetermined zone of a signal including 10 dB white noise. FIG. 13 shows graphs for comparing a method of detecting a voiced sound and an unvoiced sound according to an exemplary embodiment of the present invention to that of a conventional method with respect to a predetermined zone of a signal including 0 dB white noise. Referring to each of FIGS. 11 through 13, like in FIG. 10, an unvoiced zone P2 and voiced zones P1, P3, and P4 existing in a graph (a) is more clearly classified in graphs (d) and (e).

Summarizing the comparison results, a voiced zone and an unvoiced zone can be more exactly detected from a pure voice signal without white noise and a voice signal including the white noise using a detection algorithm according to exemplary embodiments of the present invention.

In exemplary embodiments described above, a first parameter is set by multiplying a calculated slope by −1 in order to compare a waveform obtained by the first parameter and a waveform obtained by a second parameter. However, it does not matter that the calculated slope is set as the first parameter.

Exemplary embodiments may be embodied in a general-purpose computing devices by running a computer readable code from a medium, e.g. a computer-readable medium, including storage media such as magnetic storage media (ROMs, RAMs, floppy disks, magnetic tapes, etc.), and optically readable media (CD-ROMs, DVDs, etc.). Exemplary embodiments may be embodied as a medium having a computer readable program code unit embodied therein for causing a number of computer systems connected via a network to effect distributed processing. The network may be a wired network, a wireless network, or any combination thereof. Functional programs, codes and code segments for embodying the present invention may be easily deducted by programmers in the art, which the present invention belongs to.

As described above, according to exemplary embodiments of the present invention, since a voiced sound zone and an unvoiced sound zone are determined from an input signal in a block by dividing the input signal into units of predetermined size of blocks and using a spectral flatness measure (SFM) and slope of a mel-scaled filter bank spectrum obtained from the input signal existing in the block, an accuracy of discrimination between the voiced sound and the unvoiced sound is excellent, and more particularly, in a white noise environment, a performance of the discrimination is outstanding. Also, since a voiced sound zone and an unvoiced sound zone are determined using mel-scaled filter banks used for voice recognition, costly hardware or software does not have to be added, and accordingly, realizing costs are low-priced.

The apparatus, method, and medium for detecting a voiced sound zone and an unvoiced sound zone according to exemplary embodiments of the present invention can be applied to various fields such as voice detection for voice recognition, prosody information extraction for interactive voice recognition, voice encoding, and mingled noise removing.

While the above exemplary embodiments provide variable length coding of the input video data, it will be understood by those skilled in the art that fixed length coding of the input video data may be embodied from the spirit and scope of the invention.

Thus, although a few exemplary embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of detecting a voiced sound and an unvoiced sound performed by at least one computer system, the method comprising:

dividing an input signal received by the computer system into block units;

calculating a slope and a spectral flatness measure (SFM) of a mel-scaled filter bank spectrum of the input signal existing in a block;

calculating a first parameter to determine the voiced sound by using the slope of the mel-scaled filter bank spectrum of the input signal existing in the block and a second parameter to determine the unvoiced sound by using the slope and the spectral flatness measure (SFM) of the mel-scaled filter bank spectrum of the input signal existing in the block; and determining a voiced sound zone in the block by comparing the first parameter to a first threshold value and an unvoiced sound zone in the block by comparing the second parameter to a second threshold value.

2. The method of claim 1, wherein the calculating of the slope and SFM comprises:

calculating the slope by modeling the mel-scaled filter bank spectrum as a first order function; and calculating the SFM using a geometric average and an arithmetic average of a spectrum obtained by removing the slope from the mel-scaled filter bank spectrum.

3. The method of claim 1, wherein the determining of the voiced sound zone and the unvoiced sound zone comprises:

comparing a first signal waveform obtained by applying the first parameter obtained from the slope to the input signal of the block and the first threshold value;

comparing a second signal waveform obtained by applying the second parameter obtained from the slope and SFM to the input signal of the block and the second threshold value;

determining a zone, which has a value larger than the first threshold value in the first signal waveform as a result of the comparing of the first signal waveform and the first threshold value, as a voiced sound zone; and determining a zone, which has a value larger than the second threshold value in the second signal waveform as a result of the comparing of the second signal waveform and the second threshold value, as an unvoiced sound zone.

4. The method of claim 3, wherein the first parameter is obtained using a first slope calculated at an entire frequency area of the mel-scaled filter bank spectrum.

5. The method of claim 3, wherein the first parameter is obtained using a first slope calculated at an entire frequency area of the mel-scaled filter bank spectrum and a second slope calculated at a predetermined low frequency area of the entire frequency area.

6. The method of claim 3, wherein the first parameter is obtained using a first slope calculated at an entire frequency area of the mel-scaled filter bank spectrum, a second slope calculated at a predetermined low frequency area of the entire frequency area, and a third slope calculated at a predetermined high frequency area of the entire frequency area.

7. The method of claim 3, wherein the second parameter is obtained by a difference between the SFM and the slope calculated at the entire frequency area of the mel-scaled filter bank spectrum.

8. An apparatus for detecting a voiced sound and an unvoiced sound, the apparatus comprising:

a computing device;

a blocking unit to divide an input signal into block units;

a parameter calculator to calculate a first parameter to determine the voiced sound by using a slope of a mel-scaled filter bank spectrum of the input signal existing in a block and a second parameter to determine the unvoiced sound by using the slope and a spectral flatness measure (SFM) of the mel-scaled filter bank spectrum of the input signal existing in the block; and a determiner to determine a voiced sound zone in the block by comparing the first parameter to a first threshold value and a unvoiced sound zone in the block by comparing the second parameter to a second threshold value, using the computing device.

9. The apparatus of claim 8, wherein the parameter calculator comprises:

a first spectrum acquisitor to obtain a mel-scaled filter bank spectrum from an input signal existing in the block provided from the blocking unit;

a first parameter calculator to calculate the slope of the mel-scaled filter bank spectrum provided from the first spectrum acquisitor and the first parameter to determine the voiced sound using the slope;

a second spectrum acquisitor to obtain a second spectrum in which the slope at an entire frequency area is removed from the mel-scaled filter bank spectrum; and a second parameter calculator to calculate the spectral flatness measure (SFM) of the second spectrum provided from the second spectrum acquisitor and the second parameter to determine the unvoiced sound using the slope and SFM.

10. The apparatus of claim 9, wherein the first parameter calculator sets a first slope calculated at an entire frequency area of the mel-scaled filter bank spectrum as the first parameter.

11. The apparatus of claim 9, wherein the first parameter calculator adds a first slope calculated at an entire frequency area of the mel-scaled filter bank spectrum to a second slope calculated at a predetermined low frequency area of the entire frequency area, and then sets the added result as the first parameter.

12. The apparatus of claim 9, wherein the first parameter calculator adds a first slope calculated at an entire frequency area of the mel-scaled filter bank spectrum, a second slope calculated at a predetermined low frequency area of the entire frequency area, and a third slope calculated at a predetermined high frequency area of the entire frequency area and sets the added result as the first parameter.

13. The apparatus of claim 9, wherein the second parameter calculator sets a difference between the SFM and the slope calculated at the entire frequency area of the mel-scaled filter bank spectrum as the second parameter.

14. The apparatus of claim 9, wherein the determiner compares a first signal waveform obtained by applying the first parameter obtained from the slope to the input signal of the block and the first threshold value and determines a zone, which has a value larger than the first threshold value in the first signal waveform as a result of the comparing of the first signal waveform and the first threshold value, as a voiced sound zone.

15. The apparatus of claim 9, wherein the determiner compares a second signal waveform obtained by applying the second parameter obtained from the slope and SFM to the input signal of the block and the second threshold value and determines a zone, which has a value larger than the second threshold value in the second signal waveform as a result of the comparing of the second signal waveform and the second threshold value, as an unvoiced sound zone.

16. A non-transitory medium comprising computer-readable instructions, to execute a method for detecting a voiced sound and an unvoiced sound performed by at least one computer system, implementing:

dividing an input signal received by the computer system into block units;

calculating a slope and a spectral flatness measure (SFM) of a mel-scaled filter bank spectrum of the input signal existing in a block;

calculating a first parameter to determine the voiced sound by using the slope of the mel-scaled filter bank spectrum of the input signal existing in the block and a second parameter to determine the unvoiced sound by using the slope and the spectral flatness measure (SFM) of the mel-scaled filter bank spectrum of the input signal existing in the block; and determining a voiced sound zone in the block by comparing the first parameter to a first threshold value and an unvoiced sound zone in the block by comparing the second parameter to a second threshold value.

17. The medium of claim 16, wherein the calculating of the slope and SFM comprises:

calculating the slope by modeling the mel-scaled filter bank spectrum as a first order function; and calculating the SFM using a geometric average and an arithmetic average of a spectrum obtained by removing the slope from the mel-scaled filter bank spectrum.

18. The medium of claim 16, wherein determining of the voiced sound zone and the unvoiced sound zone comprises:

comparing a first signal waveform obtained by applying the first parameter obtained from the slope to the input signal of the block and the first threshold value;

comparing a second signal waveform obtained by applying the second parameter obtained from the slope and SFM to the input signal of the block and the second threshold value;

determining a zone, which has a value larger than the first threshold value in the first signal waveform as a result of the comparing of the first signal waveform and the first threshold value, as a voiced sound zone; and determining a zone, which has a value larger than the second threshold value in the second signal waveform as a result of the comparing of the second signal waveform and the second threshold value, as an unvoiced sound zone.

19. The medium of claim 18, wherein the first parameter is obtained using a first slope calculated at an entire frequency area of the mel-scaled filter bank spectrum.

20. The medium of claim 18, wherein the first parameter is obtained using a first slope calculated at an entire frequency area of the mel-scaled filter bank spectrum and a second slope calculated at a predetermined low frequency area of the entire frequency area.

21. The medium of claim 18, wherein the first parameter is obtained using a first slope calculated at an entire frequency area of the mel-scaled filter bank spectrum, a second slope calculated at a predetermined low frequency area of the entire frequency area, and a third slope calculated at a predetermined high frequency area of the entire frequency area.

22. The medium of claim 18, wherein the second parameter is obtained by a difference between the SFM and the slope calculated at the entire frequency area of the mel-scaled filter bank spectrum.

* * * * *

UNITED STATES PATENT AND TRADEMARK OFFICE

CERTIFICATE OF CORRECTION

PATENT NO. : 7,809,554 B2
APPLICATION NO. : 11/050666
DATED : October 5, 2010
INVENTOR(S) : Kwangcheol Oh It is certified that error appears in the above-identified patent and that said Letters Patent is hereby corrected as shown below:

Title Page Item (54) (Title), Line 1 after "METHOD" insert -- , --.

Column 1, Line 1 after "METHOD" insert -- , --.

Signed and Sealed this
Fourth Day of January, 2011

David J. Kappos

David J. Kappos
*Director of the United States Patent and Trademark Office*